US008881701B2

(12) United States Patent
Schober

(10) Patent No.: US 8,881,701 B2
(45) Date of Patent: Nov. 11, 2014

(54) CAMSHAFT ADJUSTING DEVICE

(75) Inventor: Michael Schober, Behamberg (AT)

(73) Assignee: MAGNA Powertrain AG & Co KG, Lannach (AT)

( * ) Notice: Subject to any disclaimer, the term of this patent is extended or adjusted under 35 U.S.C. 154(b) by 88 days.

(21) Appl. No.: 13/816,281

(22) PCT Filed: Jul. 6, 2011

(86) PCT No.: PCT/EP2011/003363

§ 371 (c)(1),
(2), (4) Date: Apr. 24, 2013

(87) PCT Pub. No.: WO2012/019680

PCT Pub. Date: Feb. 16, 2012

(65) Prior Publication Data

US 2013/0291815 A1 Nov. 7, 2013

(30) Foreign Application Priority Data

Aug. 10, 2010 (DE) ..... 10 2010 033 897

(51) Int. Cl.
*F01L 1/34* (2006.01)
*F01L 1/352* (2006.01)

(52) U.S. Cl.
CPC ..... *F01L 1/352* (2013.01)
USPC ..... 123/90.17

(58) Field of Classification Search
CPC ..... F01L 1/356; F01L 1/352; F01L 1/34403; F01L 1/344; F01L 1/34406
USPC ..... 123/90.15–90.17
See application file for complete search history.

(56) References Cited

U.S. PATENT DOCUMENTS

| | | | | |
|---|---|---|---|---|
| 7,383,802 | B2 * | 6/2008 | Ido et al. | 123/90.17 |
| 2005/0124452 | A1 | 6/2005 | Stoianovici | |
| 2007/0169731 | A1 | 7/2007 | Farah | |
| 2010/0095920 | A1 | 4/2010 | Morishima | |
| 2011/0036319 | A1 * | 2/2011 | Kameda et al. | 123/90.17 |
| 2011/0226202 | A1 | 9/2011 | Nagado | |

FOREIGN PATENT DOCUMENTS

| | | | |
|---|---|---|---|
| DE | 10 2004 007052 | A1 | 9/2005 |
| DE | 10 2008 040256 | A1 | 1/2009 |

* cited by examiner

*Primary Examiner* — Thomas Denion
*Assistant Examiner* — Daniel Bernstein
(74) *Attorney, Agent, or Firm* — Jordan IP Law, LLC; Todd A. Vaughn

(57) ABSTRACT

An adjusting device for adjusting a camshaft relative to a drive sprocket, which drives the camshaft coaxially. The adjusting device includes an actuating gear which acts between the drive sprocket and the camshaft and is driven via an electric motor to adjust the camshaft. The actuating gear has internally- and externally-toothed gearwheels in engagement with each other, in which the internally toothed gearwheel is rotated about a central axis of the adjusting device. The externally toothed gearwheel is arranged eccentrically with respect to the central axis and is driven to perform a circular motion about the central axis. The externally toothed gearwheel is supported eccentrically on at least two eccentric shafts, each eccentric shaft being driven to perform a rotary motion about a respective eccentric axis. The eccentric axes are arranged eccentrically with respect to the central axis and can be rotated about the central axis.

20 Claims, 3 Drawing Sheets

CAMSHAFT ADJUSTING DEVICE

CROSS-REFERENCE TO RELATED APPLICATIONS

The present application is a National Stage Application of PCT International Application No. PCT/EP2011/003363 (filed on Jul. 6, 2011), under 35 U.S.C. §371, which claims priority to German Patent Application No. 10 2010 033 897.4 (filed on Aug. 10, 2010), which are each hereby incorporated by reference in their respective entireties.

TECHNICAL FIELD

The invention relates to an adjusting device for adjusting a camshaft relative to a drive sprocket, which drives the camshaft coaxially, wherein the drive sprocket and the camshaft are arranged coaxially with respect to a central axis of the adjusting device.

BACKGROUND

In an internal combustion engine of a motor vehicle, the crankshaft is coupled by a chain drive, a toothed belt drive or a gear drive to a drive sprocket which drives the camshaft essentially in synchronism with the crankshaft. By means of the camshaft, the valve opening times of the internal combustion engine are controlled. By means of an adjusting device of the type stated, the phase angle of the camshaft relative to the drive sprocket (and thus relative to the crankshaft) can be selectively modified in order to influence the combustion processes taking place in the internal combustion engine.

For this purpose, an actuating gear can act between the drive sprocket and the camshaft, it being possible to drive said actuating gear by means of an electric motor in order to adjust the camshaft relative to the drive sprocket. The use of an electric motor allows particularly accurate control.

In an arrangement of this kind, the actuating gear forms a summing gear, in which the drive sprocket is associated with a first input, an output element of the electric motor (e.g., a motor pinion) is associated with a second input, and the camshaft or a camshaft section (e.g., a camshaft flange) is associated with an output of the summing gear. It is advantageous here if the drive sprocket, the output element of the electric motor and the camshaft can be rotated coaxially with respect to one another to enable the entire unit consisting of the drive sprocket, the electric motor, the actuating gear and the camshaft to rotate about a common axis, referred to as the central axis.

In order to be able to adjust the camshaft relative to the drive sprocket, relatively high torques must be produced. To enable this function to be performed by a high speed electric motor of small size, the actuating gear must bring about a large reduction in the speed of the electric motor (based on a fixed drive sprocket). For this purpose, the actuating gear can have an internally toothed gearwheel and an externally toothed gearwheel in engagement with the latter, wherein the internally toothed gearwheel can be rotated about the central axis mentioned, and the externally toothed gearwheel is arranged eccentrically with respect to the central axis and, in this eccentric arrangement, can be driven so as to perform a circular motion about the central axis. Since the externally toothed gearwheel rolls on the internally toothed gearwheel, a relatively slow rotation of the externally toothed gearwheel (relative to the internally toothed gearwheel) is superimposed on the circular motion mentioned. If, in an arrangement of this kind, the externally toothed gearwheel has only slightly fewer teeth than the internally toothed gearwheel meshing therewith (e.g., a difference of 1 to 5 teeth), large ratios can thereby advantageously be formed (e.g., 60 to 300).

One problem of an actuating gear of this kind, however, is that the externally toothed gearwheel meshing with the internally toothed gearwheel is arranged eccentrically with respect to the central axis of the adjusting device. It is, therefore, not readily possible to transmit the circular motion of the externally toothed gearwheel to an input element or output element of the actuating gear (e.g., to the camshaft), which—as explained above—should each be arranged coaxially with the central axis.

SUMMARY

It is an object of the invention to provide a camshaft-adjusting device of the type stated at the outset in which the actuating gear brings about a large speed reduction while being compact in construction and highly efficient.

This object is achieved by means of an adjusting device for adjusting a camshaft relative to a drive sprocket, which drives the camshaft coaxially, wherein the drive sprocket and the camshaft are arranged coaxially with respect to a central axis of the adjusting device, having an actuating gear, which acts between the drive sprocket and the camshaft and which can be driven by means of an electric motor in order to adjust the camshaft, wherein the actuating gear has an internally toothed gearwheel and an externally toothed gearwheel in engagement with the latter, wherein the internally toothed gearwheel can be rotated about the central axis, and the externally toothed gearwheel is arranged eccentrically with respect to the central axis and can be driven so as to perform a circular motion about the central axis, wherein the externally toothed gearwheel is supported eccentrically on at least two eccentric shafts, wherein each eccentric shaft can be driven so as to perform a rotary motion about a respective eccentric axis, wherein the eccentric axes are arranged eccentrically with respect to the central axis and can be rotated about the central axis.

In the adjusting device in accordance with the invention, therefore, at least two eccentric axes are provided, these being arranged eccentrically with respect to said central axis of the adjusting device and, in particular, being arranged parallel to one another. The arrangement of the eccentric axes, which are in a fixed position relative to one another, can be rotated about the central axis, i.e. the arrangement comprising at least two eccentric axes can be rotated coaxially with the drive sprocket, the electric motor and the camshaft, wherein the respective position of the eccentric axes is defined by a common carrier device, for example.

Each eccentric axis is assigned a respective eccentric shaft. Each eccentric shaft comprises an eccentric portion (i.e., a cam) and can be driven so as to perform a rotary motion about the respective eccentric axis. Said externally toothed gearwheel, which is in engagement with said internally toothed gearwheel, is supported on the at least two eccentric shafts, thus enabling the externally toothed gearwheel to be driven so as to perform said (eccentric) circular motion about the central axis by the rotary motion of the eccentric shafts about the respective eccentric axis.

The required eccentricity of the externally toothed gearwheel can thus be provided by the respective eccentric portion of the eccentric shafts, wherein the eccentric axes associated with the eccentric shafts can jointly perform a rotary motion coaxial with the central axis. The eccentric shafts, which can be rotated about the eccentrically arranged eccentric axes, thus make it possible for the eccentric circular motion (with superimposed rotation) of the externally toothed gearwheel to be brought back to a rotary motion about the central axis of the adjusting device, namely in the form of a rotation of said eccentric axes about the central axis. The two inputs and the output of the actuating gear can, therefore, all be arranged coaxially with the central axis.

Thus, through the use of a coaxial internally toothed gearwheel and of an eccentric externally toothed gearwheel that meshes with the latter, it is possible to obtain an actuating gear with a large reduction ratio in a small overall volume, wherein a simple construction is possible and a high degree of efficiency can be achieved through the coaxial embodiment of the two input elements and the output element of the actuating gear.

Advantageous embodiments of the invention are explained below and cited in the dependent claims.

In accordance with a preferred embodiment, the externally toothed gearwheel is supported on the eccentric shafts by means of respective rolling contact bearings. It is thereby possible to produce the eccentric circular motion of the externally toothed gearwheel and the resulting torque transmission with particularly high efficiency. In accordance with another embodiment, the externally toothed gearwheel can be supported on the eccentrics by means of respective plain bearings.

It is furthermore preferred if each eccentric shaft is rotatably supported on a respective bearing journal—referred to as the eccentric journal, wherein the eccentric journals define said eccentric axes and are secured on a common carrier device. Particularly simple mounting of the rotatably drivable eccentric shafts is thereby possible. In this embodiment, the eccentric shafts are embodied, in particular, as hollow shafts, which are supported internally on the eccentric journals. As an alternative, however, the eccentric shafts can engage directly in the manner of journals in a common carrier device, for example, and can be rotatably supported thereon on the outside.

It is furthermore preferred here if the eccentric shafts are once again supported on the eccentric journals by means of respective rolling contact bearings. This further increases the efficiency of the actuating gear since rolling contact support can be provided throughout for the motion of the externally toothed gearwheel.

In accordance with another preferred embodiment, the internally toothed gearwheel is connected to the drive sprocket for conjoint rotation, and the arrangement of the plurality of eccentric axes (in particular the arrangement of the plurality of eccentric journals) is connected to the camshaft in a manner which prevents relative rotation. In other words, in this case the internally toothed gearwheel forms an input and the arrangement of the plurality of eccentric axes forms the output of the actuating gear. It is thereby possible to obtain an actuating gear of particularly compact construction, wherein, in particular, a one-piece design of the internally toothed gearwheel with the drive sprocket is also possible. In principle, however, a reverse arrangement is possible.

It is furthermore preferred if said eccentric shafts can be driven by means of the electric motor so as to perform a rotary motion about the respective eccentric axis. In other words, in this case the eccentric shafts supporting the externally toothed gearwheel are associated with an input to the actuating gear.

The eccentric shafts can preferably be driven so as to perform a mutually synchronous rotary motion about the respective eccentric axis in order to bring about the desired circular motion of the externally toothed gearwheel.

In accordance with a preferred embodiment, each eccentric shaft is connected for conjoint rotation to a respective coupling gearwheel (in particular of one-piece design). In this case, the electric motor can drive a motor pinion, which is arranged coaxially with the central axis of the adjusting device and meshes, directly or via at least one common intermediate gearwheel, with the coupling gearwheels. In this way, the eccentric support of the eccentric shafts can be brought back to a drive coaxial with the central axis in addition to the synchronous drive.

The coupling gearwheels and the intermediate gearwheel (where present) are preferably arranged radially fully within the toothing of the externally toothed gearwheel in every position of the actuating gear.

In other words, the coupling gearwheels and, if appropriate, the intermediate gearwheel are arranged fully within an imaginary cylindrical envelope concentric with the central axis, wherein the cylindrical envelope is fully within the toothing of the externally toothed gearwheel in every position of the gear, and it is therefore possible for the tooth width of the externally toothed gearwheel and likewise the tooth width of the internally toothed gearwheel to continue axially beyond the coupling gearwheels and/or the intermediate gearwheel. The coupling gearwheels and/or the intermediate gearwheel can thus be arranged partially or completely within the externally toothed gearwheel and the internally toothed gearwheel in the axial direction. This reduces the axial overall length of the actuating gear.

In accordance with another embodiment, two, three or four eccentric shafts are provided, which can be driven rotatably about a respective eccentric axis in order to drive the externally toothed gearwheel, wherein the eccentric axes are preferably arranged at a uniform angular pitch around the central axis.

DRAWINGS

The invention is explained below, purely by way of example, with reference to the drawings.

DESCRIPTION

The adjusting device shown in FIGS. 1 to 5 is used to adjust a camshaft 11 of an internal combustion engine (not illustrated) relative to a drive sprocket 13, which drives the camshaft 11 coaxially and is coupled, with a driving action, to a crankshaft of the internal combustion engine, e.g. via a chain drive (not shown). The drive sprocket 13 and the camshaft 11 are arranged coaxially with respect to a central axis A of the adjusting device. The drive sprocket 13 is coupled to the camshaft 11 via an actuating gear 15, which can be driven by means of an electric motor 17 in order to adjust the phase angle of the camshaft 11 relative to the drive sprocket 13.

Figure 4:
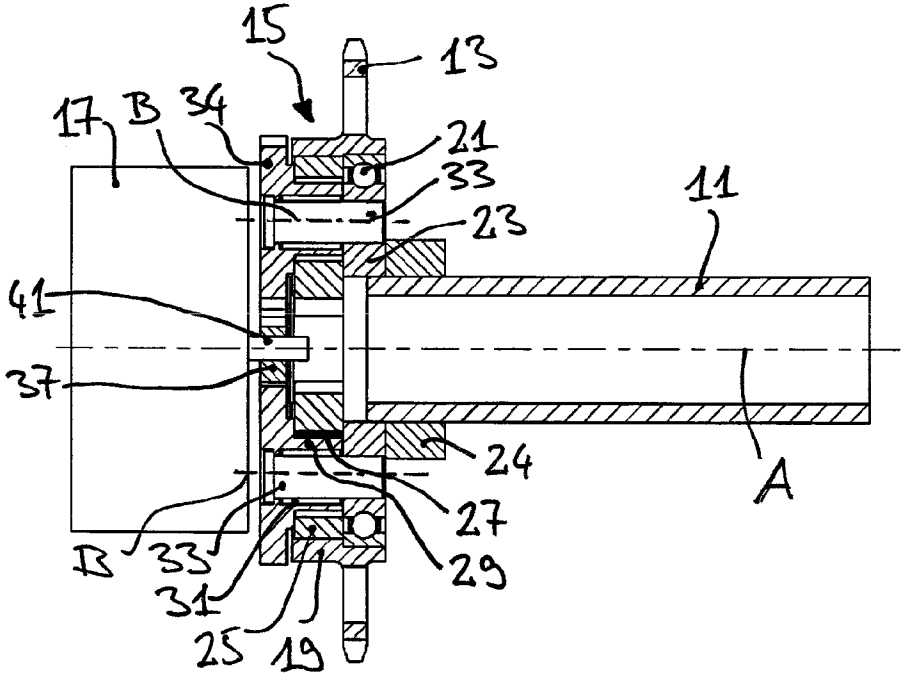
FIG. 4 illustrates a longitudinal section along the plane IV-IV in FIG. 2.
Figure 5:
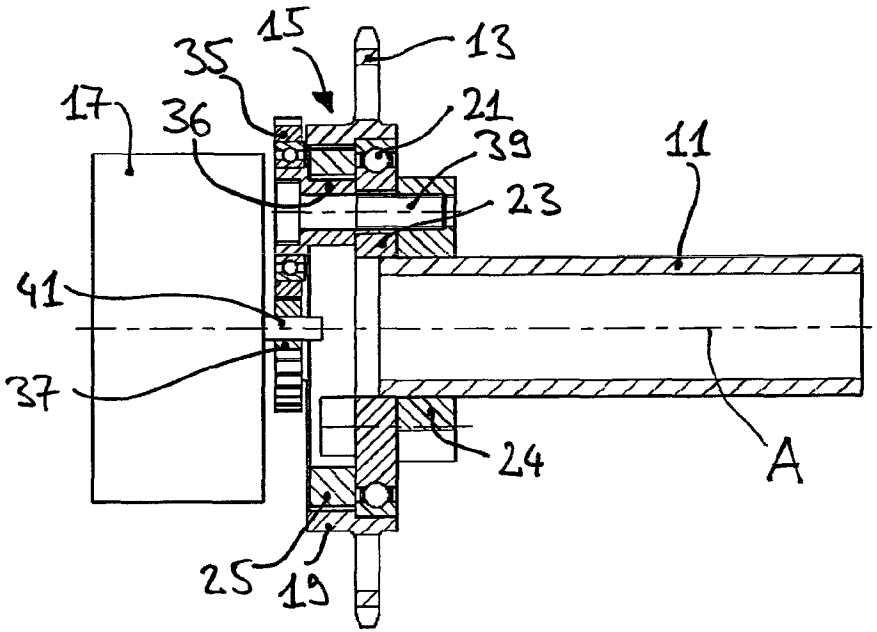
FIG. 5 illustrates a longitudinal section along the plane V-V in FIG. 1, which is rotated by 90° relative to the section plane in FIG. 4.

As illustrated, in particular, in FIGS. 4 and 5, the actuating gear 15 comprises an internally toothed gearwheel 19, which is supported rotatably on a carrier device 23 of the actuating gear 15 via a rolling contact bearing 21, coaxially with the central axis A. As can be seen from FIGS. 2 and 3, the internally toothed gearwheel 19 is in engagement with an externally toothed gearwheel 25. The externally toothed gearwheel 25 is arranged with a slight eccentricity relative to the central axis A and, in this slightly eccentric arrangement, can be driven so as to perform a circular motion about the central axis A. The difference in the number of teeth between the internally toothed gearwheel 19 and the externally toothed gearwheel 25 is very small. For example, provision can be made for the externally toothed gearwheel 25 to have just one, two, three, four or five teeth fewer than the internally toothed gearwheel 19. Accordingly—as can be seen especially from FIG. 3—the eccentricity of the externally toothed gearwheel 25 with respect to the central axis A is very small. At the top of FIG. 3, the externally toothed gearwheel 25 is in engagement with the internally toothed gearwheel 19, while, at the bottom of FIG. 3, the externally toothed gearwheel 25 is just out of engagement with the internally toothed gearwheel 19.

Figure 3:
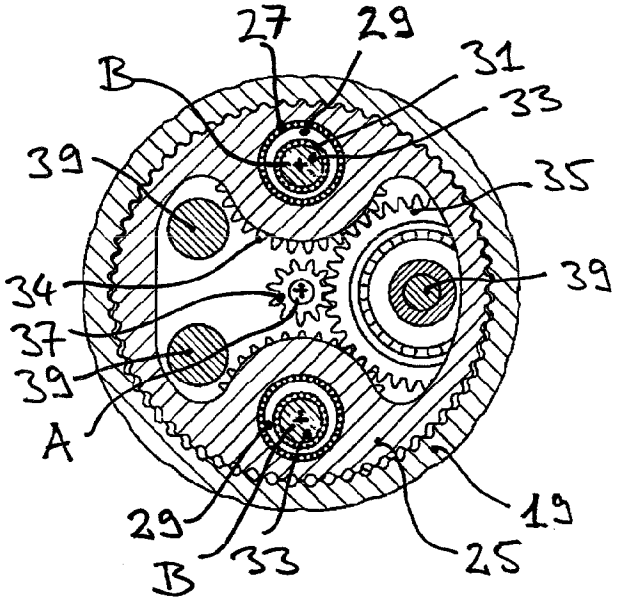
FIG. 3 illustrates a cross section along the plane III-III in FIG. 1.

FIG. 3 illustrates that the externally toothed gearwheel 25 is supported on two eccentric shafts 29 by means of respective rolling contact bearings 27. Each of the two eccentric shafts 29 is, in turn, supported on a respective eccentric journal 33 by means of a rolling contact bearing 31 and can be rotated about a respective eccentric axis B. The two eccentric journals 33 and hence the two eccentric axes B are arranged eccentrically with respect to the central axis A. As shown in FIG. 4, the two eccentric journals 33 extend parallel to one another, and they are secured on the carrier device 23, thus enabling the two eccentric journals 33 and hence the two eccentric axes B to be rotated in a fixed relative position about the central axis A.

From FIG. 3, it can be seen that the eccentricity of the respective outer circumference of the eccentric shafts 29 with respect to the respective eccentric axes B corresponds to the eccentricity of the externally toothed gearwheel 25 with respect to the central axis A. The eccentricity of the eccentric axes B with respect to the central axis A, on the other hand, is significantly greater than the eccentricity of the externally toothed gearwheel 25 with respect to the central axis A. The central axis A and the eccentric axes B are situated within the rolling circle of the externally toothed gearwheel 25.

Figure 2:
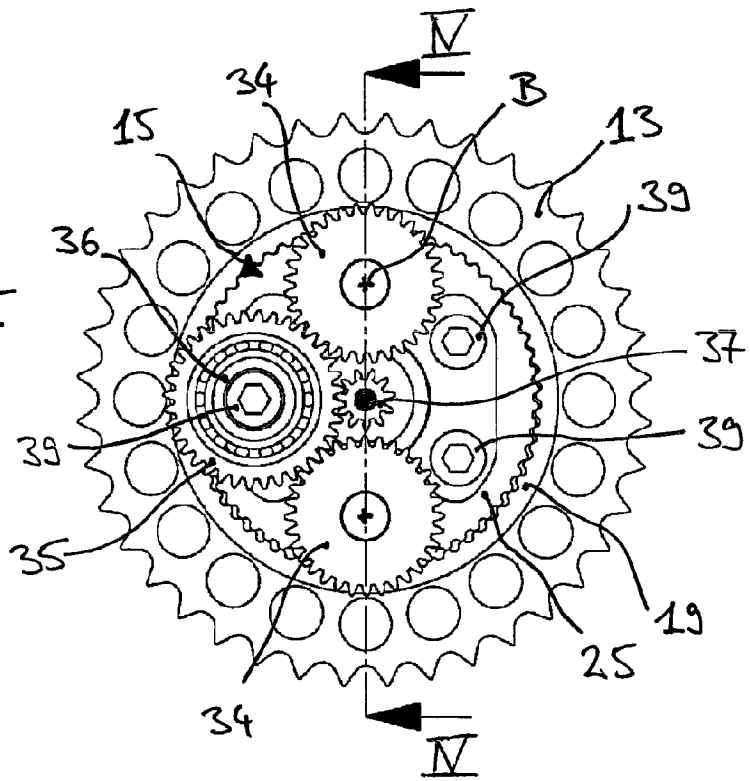
FIG. 2 illustrates a cross section along the plane II-II in FIG. 1.
Figure 1:
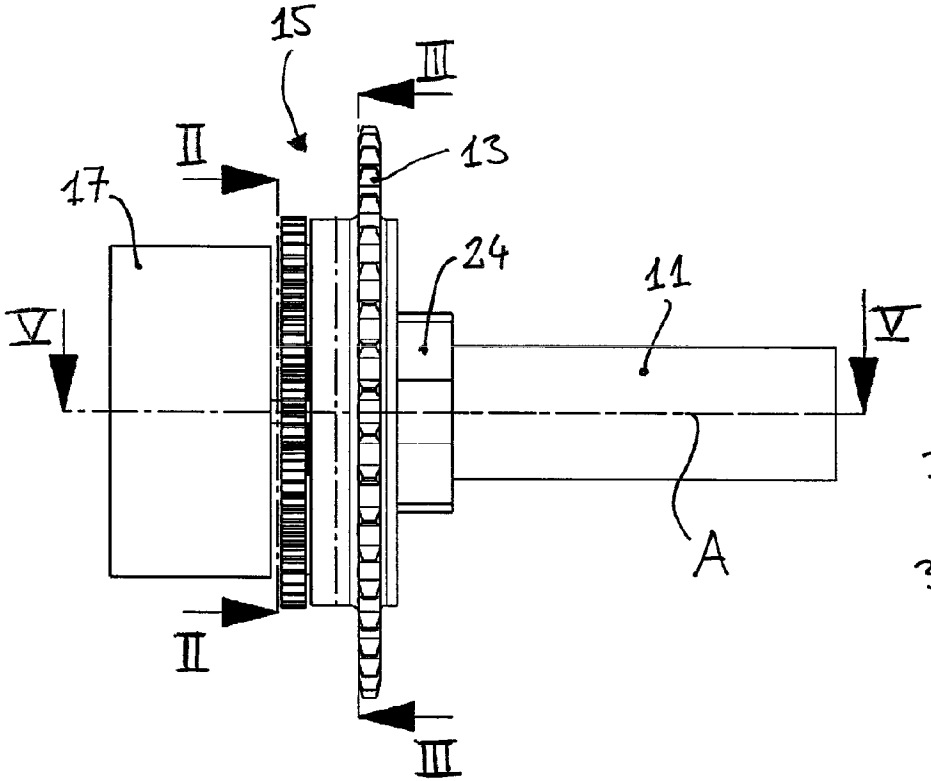
FIG. 1 illustrates a side view of an adjusting device in accordance with the invention.

From FIG. 4, it can be seen that each eccentric shaft 29 is connected for conjoint rotation to a respective coupling gearwheel 34, i.e., is of one-piece design therewith. FIG. 2 illustrates that the two coupling gearwheels 34 are in engagement with a motor pinion 37 via a common intermediate gearwheel 35. The intermediate gearwheel 35 is supported rotatably on a bearing journal 36, which is aligned parallel to the eccentric journals 33 and is likewise secured on the carrier device 23 (FIG. 5). Moreover, FIGS. 2, 3 and 5 illustrate screws 39, using which the actuating gear 15 is connected securely, by means of the carrier device 23, to a flange 24 of the camshaft 11. In this arrangement, one of the screws 39 passes coaxially through the bearing journal 36 and screws said bearing journal 36 to the camshaft flange 24 via the carrier device 23.

The motor pinion 37 is driven by the electric motor 17 via a motor shaft 41 (FIGS. 4 and 5). However, the intermediate gearwheel 35 is not absolutely essential; instead, the motor pinion 37 can also drive the two coupling gearwheels 34 directly. In both cases, the two eccentric shafts 29 are driven in synchronism by the motor pinion 37.

The actuating gear 15 forms a summing gear to enable the phase angle of the camshaft 11 relative to the drive sprocket 13 to be varied by means of the electric motor 17. In this arrangement, the internally toothed gearwheel 19 associated with the drive sprocket 13 forms a first input. The motor pinion 37 associated with the electric motor 17 forms a second input. The carrier device 23 which carries the eccentric journals 33 and is securely connected to the camshaft flange 24 forms an output of the actuating gear 15.

Insofar as the speed of the electric motor 17 and thus of the motor pinion 37 is adjusted to the speed of the drive sprocket 13, the actuating gear 15 rotates as a block about the central axis A, and the speed of the camshaft 11 thus corresponds to that of the drive sprocket 13. Briefly running the electric motor 17 more quickly or more slowly, however, allows the phase angle of the camshaft 11 to be adjusted, and the torque that has to be produced by the electric motor 17 is low. Based on a fixed drive sprocket 13, a rotary motion of the motor pinion 37 namely brings about only a slight rotation of the camshaft 11, that is to say the actuating gear 15 brings about a large speed reduction. This can be attributed essentially to the fact that the externally toothed gearwheel 25 rolls on the internally toothed gearwheel 19 during a complete circular motion of the eccentrically arranged externally toothed gearwheel 25 about the central axis A. Owing to the slight difference in the number of teeth between the two gearwheels 19, 25, a complete circular motion of the externally toothed gearwheel 25 relative to the internally toothed gearwheel 19 brings about only a slight superimposed rotation of the externally toothed gearwheel 25, corresponding namely precisely to the slight difference in the number of teeth.

In order to be able to drive the externally toothed gearwheel 25 by means of the electric motor 17 arranged coaxially with the central axis A, despite the eccentric arrangement of said gearwheel, the motor pinion 37 drives the two eccentric shafts 29 in synchronism via the intermediate gearwheel 35 and the coupling gearwheels 34 so that they perform respective rotary motions about the eccentric axes B.

From FIG. 3, it can be seen that, as a result, the externally toothed gearwheel 25 is driven so as to perform a circular motion relative to the arrangement of the eccentric journals 33, wherein the center of the externally toothed gearwheel 25 moves on a circular path around the central axis A.

In order to be able to transmit the resulting superimposed rotary motion of the externally toothed gearwheel 25 relative to the internally toothed gearwheel 19 to the camshaft 11, which is arranged coaxially with the central axis A, despite the eccentric arrangement of the externally toothed gearwheel 25, the eccentric shafts 29 that follow the rotary motion of the externally toothed gearwheel 25 are seated on the eccentric journals 33, which are securely connected to the camshaft flange 24 and thus to the camshaft 11 via the carrier device 23 by means of screws 39.

It is thus possible, as a result, to arrange the two inputs (drive sprocket 13 with internally toothed gearwheel 19 and motor shaft 41 with motor pinion 37) and the output (eccentric journals 33 with camshaft 11) of the actuating gear 15 coaxially with the central axis A and nevertheless to allow rolling contact support for all the rotating elements of the actuating gear 15. The adjusting device shown is therefore characterized by high efficiency combined with a small overall size, despite a large reduction effect of the actuating gear 15.

As a departure from the illustration in FIGS. 1 to 5, the coupling gearwheels 34 and the intermediate gearwheel 35 can be made smaller to such an extent that they are arranged radially fully within the toothing of the externally toothed gearwheel 25. This makes it possible to achieve a reduced axial overall length of the actuating gear 15, namely if the externally toothed gearwheel 25 and hence the internally toothed gearwheel 19 overlap the coupling gearwheels 34 and the intermediate gearwheel 35 partially or completely in the axial direction.

LIST OF REFERENCE SIGNS

11 camshaft
13 drive sprocket
15 actuating gear
17 electric motor
19 internally toothed gearwheel
21 rolling contact bearing
23 carrier device
24 camshaft flange
25 externally toothed gearwheel
27 rolling contact bearing
29 eccentric shaft
31 rolling contact bearing
33 eccentric journal
34 coupling gearwheel
35 intermediate gearwheel
36 bearing journal
37 motor pinion
39 screw
41 motor shaft
A central axis
B eccentric axis

What is claimed is:

1. An adjusting device configured to adjust a camshaft relative to a drive sprocket which drives the camshaft coaxially, the adjusting device comprising:

an actuating gear configured to be driven by an electric motor and in which the drive sprocket and the camshaft are coaxially arranged with respect to a central axis of the adjusting device, the actuating gear configured to be driven by an electric motor in order to act between the drive sprocket and the camshaft and thereby adjust the camshaft, the actuating gear having:

an internally toothed gearwheel configured for rotation about the central axis; and an externally toothed gearwheel configured for engagement with the internally toothed gearwheel and arranged eccentrically with respect to the central axis to be driven so as to perform a circular motion about the central axis, wherein the externally toothed gearwheel is supported eccentrically on a first eccentric shaft and a second eccentric shaft, each eccentric shaft configured to be driven so as to perform a rotary motion about a respective eccentric axis, the eccentric axes configured to be arranged eccentrically with respect to the central axis and for rotation about the central axis.

2. The adjusting device of claim 1, further comprising:

a first bearing configured to support the externally toothed gearwheel on the first eccentric shaft; and a second bearing configured to support the externally toothed gearwheel on the second eccentric shaft.

3. The adjusting device of claim 2, wherein the first bearing and the second bearing each comprise a rolling contact bearing.

4. The adjusting device of claim 3, further comprising:

a first eccentric journal configured to rotatably support the first eccentric shaft; and a second eccentric journal configured to rotatably support the second eccentric shaft.

5. The adjusting device of claim 4, wherein the eccentric journals are secured on a common carrier device.

6. The adjusting device of claim 1, further comprising:

a first eccentric journal configured to rotatably support the first eccentric shaft; and a second eccentric journal configured to rotatably support the second eccentric shaft.

7. The adjusting device of claim 6, wherein the eccentric journals are secured on a common carrier device.

8. The adjusting device of claim 1, wherein the internally toothed gearwheel is connected to the drive sprocket for conjoint rotation.

9. The adjusting device of claim 8, wherein the eccentric axes are associated with the camshaft in a manner which prevents relative rotation.

10. The adjusting device of claim 1, wherein the eccentric shafts are configured to be driven by the electric motor so as to perform a rotary motion about the respective eccentric axis.

11. The adjusting device of claim 1, wherein the eccentric shafts are configured to be driven so as to perform a synchronous rotary motion about the respective eccentric axis.

12. The adjusting device of claim 1, wherein each eccentric shaft is connected for conjoint rotation to a respective coupling gearwheel.

13. The adjusting device of claim 12, further comprising a motor pinion configured to be driven by the electric motor and which is arranged coaxially with the central axis and coupled directly with a driving action to the coupling gearwheels.

14. The adjusting device of claim 13, wherein the coupling gearwheels are arranged radially fully within the toothing of the externally toothed gearwheel in every position of the actuating gear.

15. The adjusting device of claim 12, further comprising a motor pinion configured to be driven by the electric motor and which is arranged coaxially with the central axis and coupled indirectly with a driving action, via an intermediate gearwheel, to the coupling gearwheels.

16. The adjusting device of claim 15, wherein the coupling gearwheels and the intermediate gearwheel are arranged radially fully within the toothing of the externally toothed gearwheel in every position of the actuating gear.

17. The adjusting device of claim 1, wherein the eccentricity of the eccentric shafts with respect to the respective eccentric axis corresponds to the eccentricity of the externally toothed gearwheel with respect to the central axis.

18. The adjusting device of claim 1, wherein the eccentric axes are arranged at a uniform angular pitch around the central axis.

19. An adjusting device for an internal combustion engine, the adjusting device comprising:

an actuating gear in which a drive sprocket and a camshaft of the internal combustion engine are coaxially arranged with respect to a central axis of the adjusting device, the actuating gear configured to adjust the camshaft relative to the drive sprocket, the actuating gear having:

an internally toothed gearwheel configured for rotation about the central axis; and an externally toothed gearwheel configured for engagement with the internally toothed gearwheel and arranged eccentrically with respect to the central axis to be driven so as to perform a circular motion about the central axis, wherein the externally toothed gearwheel is supported eccentrically on multiple eccentric shafts, each eccentric shaft being driven so as to perform a rotary motion about a respective eccentric axis, the eccentric axes being arranged eccentrically with respect to the central axis and also configured for rotation about the central axis.

20. The adjusting device of claim 19, further comprising:

a bearing configured to support the externally toothed gearwheel on a respective one of the eccentric shafts; and an eccentric journal configured to rotatably support a respective one of the eccentric shafts.

* * * * *